United States Patent [19]

Lindman

[11] 4,262,086

[45] Apr. 14, 1981

[54] PHOTOGRAPH DEVELOPING SOLUTION

[75] Inventor: Richard P. Lindman, Minneapolis, Minn.

[73] Assignee: F. F. D., Inc., Minneapolis, Minn.

[21] Appl. No.: 917,927

[22] Filed: Jun. 22, 1978

[51] Int. Cl.[3] ..... G03C 5/30

[52] U.S. Cl. ..... 430/482; 430/450

[58] Field of Search ..... 96/64, 663, 48 QP; 430/466, 482, 450

[56] References Cited

U.S. PATENT DOCUMENTS

| | | | |
|---|---|---|---|
| 2,315,966 | 4/1963 | Knott . | |
| 2,366,496 | 1/1945 | Dawson | 430/466 |
| 2,456,956 | 12/1948 | Knott et al. | 96/22 |
| 2,757,091 | 7/1956 | Oretzky | 430/482 |
| 3,033,682 | 5/1962 | Hunt . | |
| 3,230,089 | 1/1966 | Robinson et al. . | |
| 3,733,198 | 5/1973 | Vanreusel | 96/109 |

FOREIGN PATENT DOCUMENTS 216517 8/1956 Australia .

OTHER PUBLICATIONS

Photographic Journal, Borkin, "Ultra-Rapid Processing of Photographic Materials", vol. 87B, 1947, pp. 108–111.

Journal of SMPTE, Ives et al., "Simplification of Motion Picture Processing Methods", vol. 55, Jul. 1950, pp. 3–26.

Glafkides, Photographic Chemistry, vol. 1, 1960, p. 109.

PSA Journal, vol. 15, Feb. 1949, pp. 130–136.

Journal of Photographic Science, vol. 2, 1954, pp. 7–14.

*Primary Examiner*—Mary F. Downey

*Attorney, Agent, or Firm*—John W. Adams

[57] ABSTRACT

A developer for black and white film comprising an active portion which includes from 16 percent to 23 percent by weight of hydroquinone, 23 percent to 30 percent by weight of a developer selected from the group consisting of Metol and Elon, 24 percent to 31 percent by weight potassium bromide and 24 percent to 32 percent by weight of sodium hydroxide such that the total percentage of these active ingredients comprises 100 percent of the active weight. Also included is a preservative portion such as sodium sulfite in amounts ranging from one-third to three times the weight of the active portion of the developer solution. Finally, sufficient water is present in the developer of this invention to provide an aqueous solution of the active portion of less than ten percent by weight active portion, based on the amount of water.

6 Claims, No Drawings

PHOTOGRAPH DEVELOPING SOLUTION

BACKGROUND OF THE INVENTION

The process for developing film and particularly black and white film is an art which has had many goals or requirements. Sometimes these goals are, or tend to be, mutually exclusive, such that improvement in one area tends to substantially adversely affect another area. For example, speed of development of the film, when taken as a prime goal, can detract from the quality of the negative to sometimes destroy the utility of the entire photograph.

Many ingredients have been tried in the developing process, with varying results being achieved, many times depending upon the specific ingredients being used in association with other particular ingredients. Among the developing agents which have been found to be most successful are the well-known hydroquinone and the monomethyl-p-aminophenol sulphates known as Elon and Metol.

Interest in rapid development of film is of course not new. One useful and informative description of efforts toward improving the speed of developing films is presented in the PSA Journal, Vol. 15, February 1949, in an article by J. I. Crabtree. Further work by that author and others is disclosed in the Journal of Photographic Science, Vol. 2, 1954, on pps. 7 through 14. In addition, prior art patents disclose various ingredients useful in the developing process of black and white film. Representative of these patents are U.S. Pat. Nos. 2,315,966, 3,033,682, 3,230,089 and Australian Pat. No. 216,517.

In spite of the many advances in the art of developing film, search still continues for increased speed in film developing without simultaneous loss of quality. Accordingly, it is the object of the invention to provide a rapid developing solution for use with black and white film. Another object of this invention is to provide a developer solution which has a very useful shelf life and which permits development of the film without adverse effects on the quality of the negatives being produced. Other objects will appear hereinafter.

DESCRIPTION OF THE INVENTION

It has now been discovered that the above and other objects of the present invention can be accomplished in the following manner. Specifically, a developer has been discovered for use with black and white film which permits rapid development of film while maintaining the quality of the resulting negative.

The developer includes an active portion which contains from 16 percent to 23 percent by weight of hydroquinone, 23 percent to 30 percent by weight of developer selected from Metol and Elon, from 24 percent to 31 percent by weight of potassium bromide and from 24 percent to 32 percent by weight sodium hydroxide. These percentages of the active portion are based upon the totality of the weight of the active portion.

Also included is a preservative portion (eg. sodium sulfite) in amounts ranging from about one-third to three times the weight of the active portion of the developer solution. Finally, sufficient water is added to give an aqueous solution of the active portion of less than 10 percent by weight portion, based upon the amount of water.

As has been stated above, a quantity of hydroquinone is employed in the developer of this invention. Hydroquinone is a known developing agent and should be present in an amount ranging from about 16 percent to 23 percent by weight, based upon the weight of the active portion described above. The preferred range of the hydroquinone will be from about 19 percent to about 21 percent by weight, based on the active portion weight.

Also included as a developing agent is a developer selected from the group consisting of Metol and Elon. Both of these materials are trade names for monomethyl-p-aminophenol sulphate. The amount of this developer should range from about 23 percent to about 30 percent by weight, based on the weight of the active portion. The preferred range of this developer is from 26 percent to 28 percent.

Also included in the developer of this invention is a quantity of a restrainer, potassium bromide. The potassium bromide, which serves to prevent fogging of the negative, should be present in an amount ranging from about 24 percent to about 31 percent by weight, based on the weight of the active portion. A preferred range of the potassium bromide is from 27 percent to about 29 percent by weight.

Finally, the remaining ingredient in the active portion of the developer of this invention is a quantity of sodium hydroxide which serves as an activator. The activator, sodium hydroxide, should be present in an amount ranging from about 24 percent to 32 percent by weight, based upon the total weight of the active portion. A preferred range of the sodium hydroxide is from about 27 percent to about 29 percent.

Along with the active portion of the developer of this invention is a preservative portion which includes a quantity of sodium sulphite such that the amount of sodium sulphite ranges from one-third to three times the weight of the active portion of this developer. A preferred range of sodium sulphite is from about 1.5 to about 2 times the amount of weight of active portion.

Finally, sufficient water is added to the developing active portion and preservative portion to give an aqueous solution of the active portion of less than about 10 percent by weight active portion, based upon the amount of water. A preferred quantity of water is sufficient water to give a solution of the action portion described above of from about 0.5 percent to 5.0 percent by weight, based upon the amount of water.

In order to form a developer solution according to the present invention, it is preferred that the following method be employed. Specifically, it is preferred that the developer solution of the present invention be prepared by mixing the active portion and the preservative portion of this developer in sufficient water to dissolve the active portion while maintaining the amount of active portion above 10 percent by weight, based upon the amount of water. This mixing should be accomplished when the water temperature is from about 100° F. up to about 130° F., and preferably at approximately 110° F. Once the active portion is dissolved, additional water should be added to cool the solution to room temperature and to give an aqueous solution of the active portion of less than 10 percent by weight, based upon the amount of water. Preferably, the final concentration of active portion of water will range from about 0.5 percent to about 5.0 percent active portion, based upon the weight of the water.

To demonstrate the efficiency of the present invention, a quantity of developer utilizing the principals of this invention was prepared. Various films were then developed and compared with development of identical films using conventional developers.

In these specific examples, approximately three quarters of a gallon of water was heated to 110° F. To this water was added 15 grams of hydroquinone, 20 grams of Metol, 20 grams of potassium bromide and 20 grams of sodium hydroxide. Also added was 130 grams of sodium sulphite, and all of these ingredients were stirred until completely dissolved in the ¾ of a gallon of water. As a result, the solution contained 7.3 percent by weight hydroquinone, 10 percent by weight Metol, 10 percent by weight potassium bromide and 10 percent by weight sodium hydroxide with each of these percentages being based upon 100 percent of the weight of the all of the above ingredients (including the 130 grams of sodium sulphite) added to the ¾ gallon of water. Additionally, 1.8 times as much sodium sulphite was present as the total amount of the active portion of this developer. The amount of all of the above ingredients (including the 130 grams of sodium sulphite) is slightly more than 7 percent by weight, based on the amount of water. At this point, an additional one quarter of a gallon of water was added to cool down the temperature to approximately room temperature. One of the advantages of the developer of this invention is that it is highly suitable for use at room temperature, or commonly 68° F., which is the acceptable standard room temperature in many photographic laboratories.

A number of different films were developed by the above described developer. The results were compared with results achieved using conventional developers, such as the commercially available developers. In each case, other parts of the developing process which are conventional were employed and need not be described herein.

In a first experiment, a quantity of "Plus X" film was developed using the developer of this invention as described above. Quality negatives were produced in approximately two minutes, which is to be compared with conventional developers which require approximately seven minutes developing time. Similarly, a quantity of "Tri X" film was developed in two minutes forty seconds, compared to nine minutes for a conventional developer. Similar results were obtained when GAF 120 was developed in 2.5 minutes compared to four to four and one-half minutes using prior art developers. Finally, some ILFORD 400 film was developed in two minutes forty seconds, compared to seven minutes using prior art developers.

In each case, the quality of the negatives was at least as good as that done by prior art developers. There was no excess grain development, even when enlargements up to 11×14 were made. There was a high contrast level and no excess fogging compared to that obtained with conventional developers. Since no agitation is needed in the use of this developer, negative streaking is substantially eliminated. It was also discovered that the developer prepared to the above description has an active shelf life up to four weeks, as opposed to a single day for most rapid developing solutions. The substantial improvements in developing time permit the processing of substantially more rolls of film with given equipment, without any loss in the quality of the resulting negatives. The exceptionally long shelf life of this active solution permits much greater flexibility in the use of dark rooms, particularly when both speed and quality are desired.

What is claimed is:

1. A developer for black and white film, comprising:

an active portion including from 16 percent to 23 percent by weight of hydroquinone; 23 percent to 30 percent by weight of a developer selected from Metol and Elon; 24 percent to 31 percent by weight potassium bromide; and 24 percent to 32 percent by weight sodium hydroxide; said percentages totaling 100 percent of the active portion weight;

a preservative portion of sodium sulphite in an amount ranging from approximately one-third to three times the weight of the active portion; and sufficient water to give an aqueous solution of said active portion.

2. The developer of claim 1 wherein the amount of hydroquinone ranges from 19 percent to 21 percent by weight, the amount of developer selected from Metol and Elon ranges from 26 percent to 28 percent by weight, the amount of potassium bromide ranges from 27 percent to 29 percent by weight and the amount of sodium hydroxide ranges from 27 percent to 29 percent by weight, based upon the weight of the total amount of active portion.

3. the developer of claim 1 wherein the amount of sodium sulphite ranges from 1.5 to two times the weight of active portion.

4. The developer of claim 1 wherein the amount of active portion, based upon the amount of water ranges from 0.5 percent to 5.0 percent.

5. The developer of claim 1 wherein said aqueous solution is formed by mixing said active portion and sals preservative portion in sufficient water to keep said active portion above 5 percent by weight, based upon the amount of water at a temperature of about 100° F. to 130° F. until said active portion is dissolved, followed by dilution of sufficient water to give an aqueous solution of said active portion of less than 5 percent by weight, based upon the weight of the water.

6. The developer of claim 5 wherein the amount of active portion ranges from 0.5 percent to 5.0 percent by weight, based upon the weight of water.

* * * * *